United States Patent [19]

Breslow et al.

[11] 4,034,985

[45] July 12, 1977

[54] TIME-CONTROLLED TILTABLE BALL GAME

[75] Inventors: Jeffrey D. Breslow, Highland Park; Eugene Jaworski, Park Ridge, both of Ill.

[73] Assignee: Marvin Glass & Associates, Chicago, Ill.

[21] Appl. No.: 716,165

[22] Filed: Aug. 20, 1976

[51] Int. Cl.[2] ..... A63B 71/06; A63B 63/04

[52] U.S. Cl. ..... 273/110; 273/127 R; 273/116; 273/1 R; 273/102 A

[58] Field of Search ..... 273/127 R, 127 A, 1 R, 273/109, 110, 102 A, 102.1 C, 102.16, 115, 116, 86 C, 111, 119 A, 118 A, 123 A; 185/38; 46/43

[56] References Cited

U.S. PATENT DOCUMENTS

| | | | |
|---|---|---|---|
| 625,845 | 5/1899 | Killey | 273/110 |
| 1,212,942 | 1/1917 | Hart | 273/102 A |
| 1,222,829 | 4/1917 | Wells | 273/102 A |
| 1,557,160 | 10/1925 | Haupenthal | 273/115 |
| 2,923,122 | 2/1960 | Inman | 46/43 |
| 3,008,714 | 11/1961 | Pullen | 273/102.1 R |
| 3,565,440 | 2/1971 | Glass | 273/1 R |
| 3,754,759 | 8/1973 | Breslow et al. | 273/1 R |
| 3,891,216 | 6/1975 | Ensmann et al. | 273/102.1 C |
| 3,931,972 | 1/1976 | Fabian | 273/110 |
| 3,949,990 | 4/1976 | Polonyi | 273/118 A |

FOREIGN PATENT DOCUMENTS

| | | | |
|---|---|---|---|
| 1,453,950 | 1/1969 | Germany | 273/109 |

*Primary Examiner*—Richard C. Pinkham
*Assistant Examiner*—Lawrence Anderson
*Attorney, Agent, or Firm*—Mason, Kolehmainen, Rathburn & Wyss

[57] ABSTRACT

A game of skill of the type in which a ball traverses a generally flat surface and is propelled by tilting the surface whereby the player scores "points" by propelling the ball over the surface to targets thereon. The playing surface is formed as the upper surface of a playing board which is mounted on a central fulcrum to permit controlled tilting. The board also has legs spaced from the fulcrum for limiting the amount of tilting permissible during play of the game. The upper playing surface has a ball receiver which has a manually operable gate for opening the receiver and releasing the ball onto the playing surface. The targets are in the form of upstanding resiliently mounted plate members which can be knocked down by the ball by impact from a predetermined direction. The receiver gate is closed automatically after a given period of time by a timer which is started by the opening of the gate. The objective of the game is to release the ball from the receiver and knock down as many targets as possible and return the ball to the receiver before the gate closes, i.e., before the timed interval lapses. Traps in the form of depressions or the like are provided in the playing surface to penalize the player should the ball be manipulated into such traps.

15 Claims, 7 Drawing Figures

Fig 1
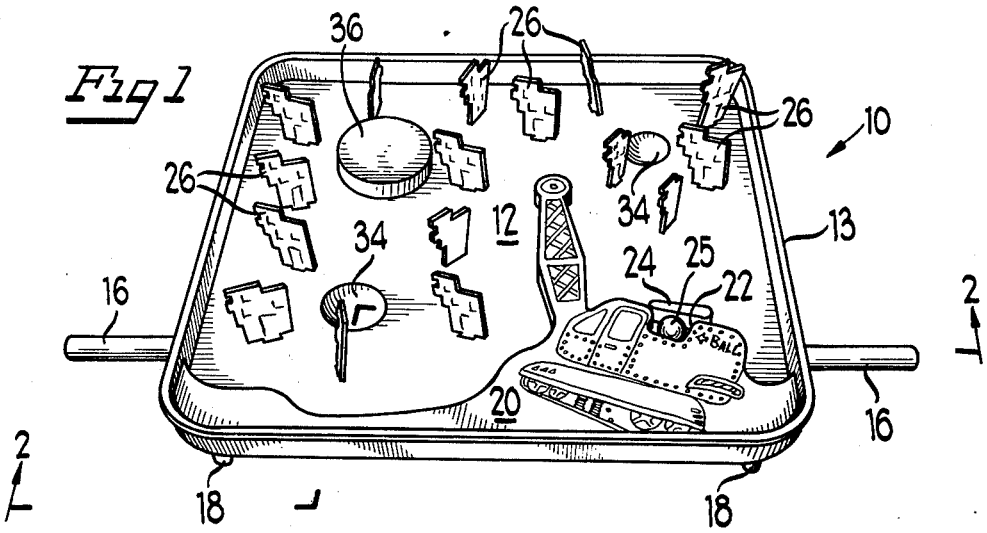
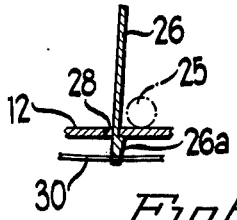
Fig 6
Fig 2
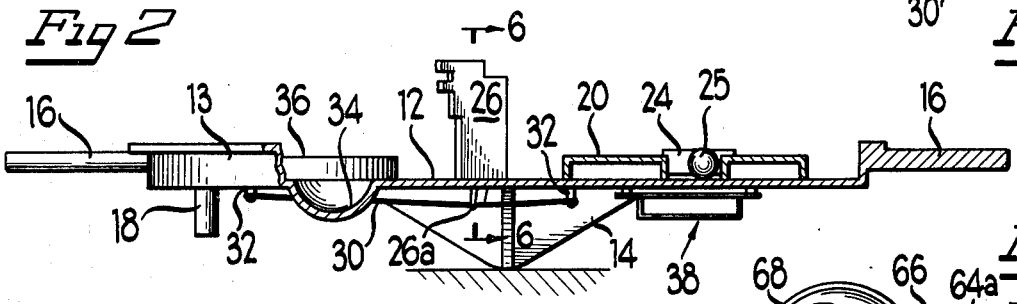
Fig 4
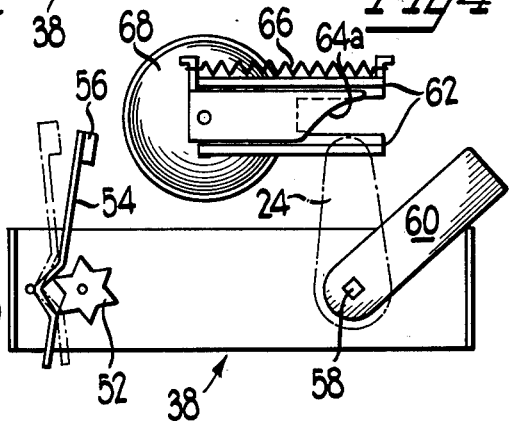
Fig 3
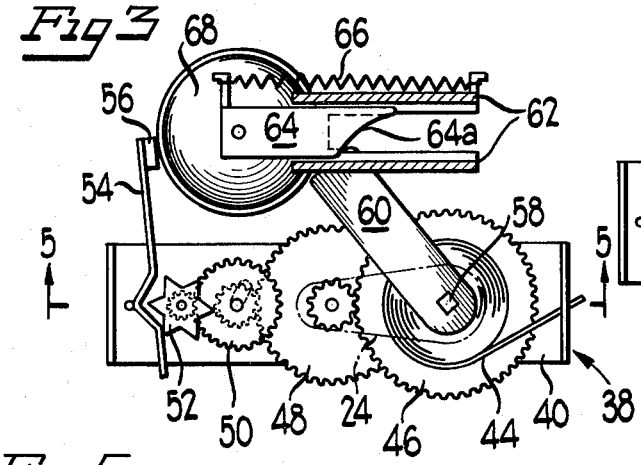
Fig 5
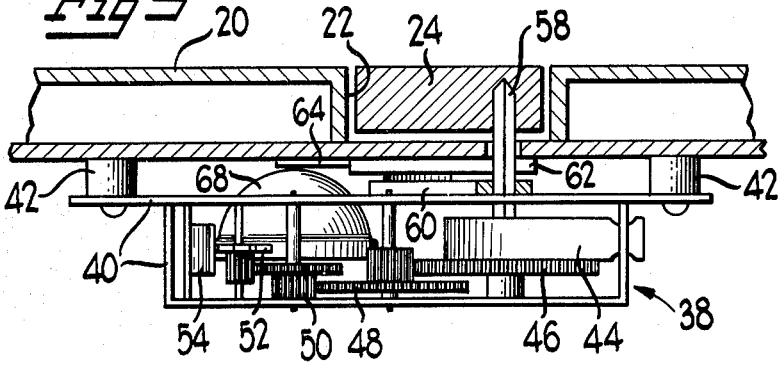
Fig 7
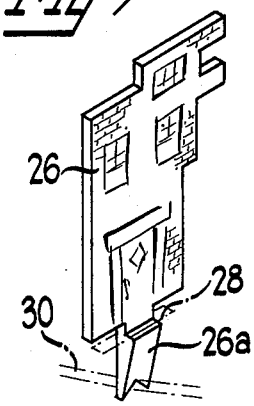

TIME-CONTROLLED TILTABLE BALL GAME

BACKGROUND OF THE INVENTION

1. Field of the Invention

This invention relates to games of skill of the type in which a ball is rolled over a playing surface by tilting the surface to direct the ball into engagement with targets.

2. Brief Description of the Prior Art

Tiltable board games in which a ball is used on a playing surface and is directed by tilting the playing surface to move the ball toward or away from depressions in the board, as either targets or penalties, have long been popular with game players. However, these games have generally been directed toward the use of targets or penalties in the form of holes or bores in the playing surface and have not given the player the excitement of seeing targets moved or ejected from the board, or the challenge of limiting play to a given time interval. Further, the depressions are usually enterable by the ball from any side thereof to produce the desired scoring effects, reducing the skill required to play the game.

SUMMARY OF THE INVENTION

The present invention provides a device which is a game of skill having tiltable playing surface with an upstanding peripheral rim defining the playing area on the surface. The surface is formed by the upper surface of a playing board and the board is mounted on a fulcrum for supporting the board on a subjacent support surface. The board is manually grippable for tilting the board on the fulcrum in any direction. The playing surface of the board is also provided with a ball receiver which releases a ball upon opening a gate for permitting the ball to roll over the surface depending on the direction of tilting. Opening the gate sets a timer mechanism which times a predetermined time interval, after expiration of which the timer closes the gate. The objective of the game is to release the ball from the receiver by opening the gate, knock down as many targets as possible and return the ball to the receiver by tilting the board before the expiration of the timed interval. The timer also actuates a warning device such as an audible warning device toward the end of the timed interval to warn the player that the ball must soon be returned to the receiver.

While this invention is susceptible of embodiment in many different forms, there is shown in the drawings and will be described in detail, a specific embodiment thereof, with the understanding that the present disclosure is to be considered as an exemplification of the principles of the invention and is not intended to limit the invention to the embodiment illustrated.

BRIEF DESCRIPTION OF THE DRAWINGS

FIG. 1 is a perspective view of an embodiment of the game of the present invention;

FIG. 2 is a slightly enlarged section taken approximately along line 2—2 of FIG. 1;

FIG. 3 is an enlarged plan view of a timer and warning system useful in the device of FIGS. 1 and 2 with the cover plate of the timer removed and the warning system in operative warning position;

FIG. 4 shows the position of the warning system before arriving in warning position FIG. 5 is a section through the timer and gate system taken along line 5—5 of FIG. 3;

FIG. 6 is a section taken along the line 6—6 of FIG. 2; and

FIG. 7 is a perspective view of an upstanding target used in the device as seen in FIG. 1.

DESCRIPTION OF THE PREFERRED EMBODIMENT

Turning first to the perspective view of the embodiment of the device of this invention as illustrated in FIG. 1, the device is a game and includes a board generally shown at 10 having an upper playing surface 12 defined within a peripheral upstanding rim 13. The board 10 has an inwardly tapered downwardly extending frusto-conical support member 14 defining a fulcrum (FIG. 2). A pair of handles 16 are provided for manipulating and tilting the board 10 while it rests on the fulcrum 14. As illustrated, the board 10 is generally square and has a leg 18 at each corner to limit the amount of tilting on fulcrum 14. The upper surface 12 has a raised portion 20 (FIGS. 1 and 2) in the form of a wrecking crane and having appropriate indicia imprinted thereon. Raised portion 20 includes a ball receiver 22 having a pivotal gate 24 (FIGS. 1 through 5), the mounting of which will be described herinafter. The receiver 22 is capable of receiving a ball such as in shown at 25. The gate 24, when in closed position, contains the ball 25 within the receiver 22.

Upstanding plate-like target members 26 (FIGS. 1, 2, 6 and 7) are provided and are printed or impressed with indicia defining features of a building to be wrecked, e.g., doors, windows and the like. The targets have foot portions **26*a* which extend downwardly through slots 28 (FIGS. 2 and 6) in the game board 10 and define shoulders engageable with the underside of the board. The foot portion of each member 26 is engaged by a rubberband, such as shown at 30, tensioned between lugs 32 at each end of the rubberband, usually one band for each target. The midportion of a rubberband engages the sole of each foot 26*a* such that the upper shoulder portion of foot 26*a* is pressed against the lower surface of the board 10 to retain the target member 26** in upstanding position as seen in FIGS. 2 and 6.

In the play of the game, the ball 25 is released from receiver 22 by manually opening gate 24 (FIG. 1) and the board 10 is tilted by a player on fulcrum 14 by manual manipulation using handles 16. The tilting of the board propels the ball by gravity over the playing surface. Each time the ball 25 impacts a target 26 on the correct side thereof, i.e., the side from which foot **26*a* protrudes (as described hereinafter), it dislodges the upper shoulder portion of the target foot portion 26*a* from the edge of the respective slot 28 and the upward urging of the rubberband 30 ejects the target 26 upwardly from the slot 28. At the end of play and return of ball 25 to receiver 22 during a predetermined time interval, the number of targets knocked down are counted and constitute the player's score. In order to reset the targets 26 they simply are reinserted foot first through slots 28 to engage a rubberband 30, with the upper shoulders of the foot portions rehooked under the board 10**.

In addition to the targets 26, traps are provided on the playing surface 12 in the form of depressions 34 within which the ball 25 can become lodged as a penalty during play. Other obstacles such as an upstanding disc 36 can be provided on playing surface 12 to impede the player or provide rebounding surfaces.

A timer 38 (FIGS. 2 through 5) is provided to automatically reclose the gate 24 after a predetermined time interval has elapsed. The timer 38 includes a frame 40 (FIG. 5) secured to the bottom of the game board 10 by suitable lugs 42. The timer 38 is driven by a coil spring 44 which is secured to and extends around a shaft 58 of a drive gear 46 which drives idler gears 48 and 50 which, in turn, drive a star wheel 52 functioning as an escape wheel. The idler gears 48 and 50 are for the purpose of stepping up the rate of rotation of star wheel 52 relative to drive gear 46. Star Wheel 52 engages and operates a pivotally mounted release or governor lever 54 through a reciprocating motion as indicated in FIG. 4. Lever 54 has a striking head or weight 56 at its upper end.

The shaft 58 is a square shaft on which gate 24 is secured so that each time gate 24 is opened, shaft 58 is rotated, as is gear 46, placing coil spring 44 under tension. Also mounted on shaft 58 is a camming crank arm 60 which pivots along with shaft 58 and gate 24 when gate 24 is opened. A frame member 62 (FIGS. 3 and 4) is secured to the bottom of board 10 and slideably supports a slide member 64 having a cam surface 64*a* engageable by crank arm 60. A tension biasing spring 66 between frame member 62 and slide member 64 normally urges slide member 64 to the right as seen in FIGS. 3 and 4. A bell 68 is secured to slide member 64 and moves bodily therewith. As timer 38 unwinds under the urging of spring 44 and at a rate controlled by the escape function of star wheel 52 in combination with release lever 54, the gate 24 begins to close. However, before the gate is closed sufficiently to prevent re-entry of ball 25 into receiver 22, the camming crank 60 engages cam surface 64*a* and drives slide member 64 relative to frame 62 from the position shown in FIG. 4 toward that shown in FIG. 3. Before the gate reaches its fully closed position of FIG. 3, however, bell 68 engages the head end 56 of receiprocating lever 54 producing an audible ringing sound as a warning to the player that the gate is about to close and that the player should manipulate the board 10 to return the ball 25 to receiver 22 before gate 24 completely closes. If the gate 24 closes before the ball is returned to the receiver 22, depending on the rules of the game, the player receives no score, incurs a penalty, or other consequence.

As pointed out above, the legs 18 which protrude from the bottom of the board 10 at the corners thereof limit the amount of tilting of the board about fulcrum 14. In other words, referring to FIG. 2, it can be seen that the legs 18 are shorter than the height of the fulcrum 14 relative to a supporting surface, such as a table, and therefore define stop limits or abutment means engageable with the supporting surface to limit the tilting of the board about fulcrum 14 and therefore limit the speed with which a ball 25 can be rolled over the playing surface. These legs 18 thus prevent a player from building up excessive momentum for the ball 25 as it is propelled over the playing surface which detracts somewhat from the skill required in playing the game as the fulcrum 14 rests on an appropriate supporting surface.

FIG. 6 shows the relationship between the enlarged foot portions 26*a* at the bottom of the targets 26, the slots 28 in the game board, and the resilient supporting band 30 which engages the underside or sole of the target foot portions 26*a*. With this arrangement, a ball 25 is capable of knocking over a target 26 when striking the target from one side (i.e., the side from which the foot portion 26*a* protrudes, the right side as viewed in FIG. 6) but precludes knocking over a target 26 when the ball strikes the same from the opposite side (the left side as viewed in FIG. 6). To this end, there should be sufficient tension in the resilient backing band 30 so as to create sufficient normal forces and thus friction between the band and the bottom of the foot portion 26*a* as well as the top of the foot portion and the underside of the playing surface 12 adjacent a slot 28. Of course, the ball 25 preferably is not of such a large weight that it can overcome these friction forces when striking a target 26 from the backside thereof (the left side as viewed in FIG. 6). Here again, the stop limit means provided by the legs 18 also would facilitate the preclusion of knocking a target over from the backside thereof by limiting the rolling speed of the ball 25 as the board is tilted about the fulcrum 14.

The foregoing detailed description is given for clearness of understanding only, and no unnecessary limitations are to be understood therefrom, as some modifications will be obvious to those skilled in the art.

We claim:

1. A device in the form of a game of skill comprising a board having an upper playing surface with an upstanding peripheral rim defining a playing area on said surface, a playing ball for propelling over said playing surface, means defining a fulcrum for supporting said board, grippable means on said board for manually tilting said board about said fulcrum to propel the ball over the playing surface, a ball receiver on said board having an operable gate for opening said receiver and releasing the ball therefrom to traverse said playing surface in the direction of tilting on said fulcrum, timer menas settable to a predetermined time interval responsive to opening said gate, and means responsive to said timer for closing said gate upon expiration of said time interval to block said ball from re-entering said ball receiver.

2. The device of claim 1 including a warning device and means responsive to said timer means for actuating said warning device during a terminal period of said time interval.

3. The device of claim 2 wherein said timer is a spring loaded timer having an escape wheel which drives a pivotally mounted reciprocating lever during unwinding of the spring, and said warning device is mounted for slideable movement towards said lever during unwinding of the timer causing the warning device to engage the lever during said terminal period of said interval.

4. The device of claim 1 wherein said board includes trap depressions in its upper surface for trapping said ball during its movement over said playing surface.

5. The device of claim 1 including an upstanding bumper obstacle on said upper surface.

6. The device of claim 1 wherein said fulcrum means is secured to and generally centrally located on the bottom of said board, and said board includes peripheral leg means shorter than said fulcrum means on the bottom of said board for limiting the amount of tilting movement on said fulcrum.

7. The device of claim 1 wherein said gate is manually operable for movement to open position and thereafter is moved to closed position by said timer means.

8. A device which is a game of skill and comprises a board having a lower surface and an upper surface with slots in said board and with an upstanding peripheral rim defining a playing area on said upper surface for supporting a playing piece for movement over said upper surface, a playing piece for movement over said upper surface, a plurality of upstanding target members extending above said upper surface for receiving impact from said playing piece, said target members having foot portions within the slots in said board with enlarged portions engaging the lower surface of the board, resilient means engaging the bottom of said foot portion to normally urge said targets upwardly from said slots upon dislodgement of said foot members from the lower surface of said board, said foot portions and slots being so proportioned that upon impact of a playing piece with one of said upstanding targets the foot portion thereof is dislodged from the slot whereby the target is driven upward by said resilient means.

9. The device of claim 8 wherein said resilient means comprises rubberbands tensioned and mounted at each end thereof to the bottom of said board with the rubberband engaging the sole of a foot portion biasing the upstanding target member upwardly from said slot.

10. The device of claim 9 wherein said upstanding targets are in the form of plates having indicia thereon of building features printed and including a ball receiver and gate that form a part of a raised portion on said upper surface having the shape and imprinted indicia of a wrecking crane.

11. A game device, comprising:

a game board having an upper playing surface, a playing object for propelling over said playing surface in response to tilting of said board to move the playing object over the playing surface for scoring purposes, a receiver on said board having gate means for opening and closing said receiver, timer means operatively associated with said gate means and settable to a predetermined time interval responsive to opening said gate means, and means responsive to said timer for closing said gate means upon expiration of said time interval to block said playing object from entering said receiver.

12. The device of claim 11 including a warning device and means responsive to said timer means for actuating said warning device during a terminal period of said time interval.

13. The device of claim 12 wherein said timer is a spring loaded timer having an escape wheel which drives a pivotally mounted reciprocating lever during unwinding of the spring, and said warning device is mounted for slideable movement towards said lever during unwinding of the timer causing the warning device to engage the lever during said terminal period of said interval.

14. The device of claim 11 including a sound device and menas responsive to said timer means for actuating said sound device at the end of said time interval.

15. The device of claim 11 including at least one upstanding target extending through a slot in said playing surface, means including tilting means for holding said upstanding target within said slot and biasing said target upwardly therefrom in response to the target being struck by said playing object.

* * * * *